US008002366B2

(12) United States Patent
Fitz

(10) Patent No.: US 8,002,366 B2
(45) Date of Patent: Aug. 23, 2011

(54) DRAWER

(75) Inventor: Helmut Fitz, Lustenau (AT)

(73) Assignee: Julius Blum Gesellschaft m.b.h., Hochst (AT)

( * ) Notice: Subject to any disclaimer, the term of this patent is extended or adjusted under 35 U.S.C. 154(b) by 1314 days.

(21) Appl. No.: 10/766,478

(22) Filed: Jan. 29, 2004

(65) Prior Publication Data

US 2004/0183412 A1 Sep. 23, 2004

(30) Foreign Application Priority Data

Mar. 19, 2003 (AT) ..... GM189/2003

(51) Int. Cl.
*A47B 88/00* (2006.01)

(52) U.S. Cl. ..... 312/348.4; 312/348.2

(58) Field of Classification Search ..... 312/348.4, 312/348.1, 348.2, 265.5, 238
See application file for complete search history.

(56) References Cited

U.S. PATENT DOCUMENTS

| | | | | | |
|---|---|---|---|---|---|
| 2,239,734 | A | * | 4/1941 | Pratt | 312/238 |
| 2,693,401 | A | | 11/1954 | Brown | |
| 3,075,820 | A | * | 1/1963 | Humphrey | 312/326 |
| 3,160,453 | A | * | 12/1964 | Tassell | 312/238 |
| 4,090,753 | A | * | 5/1978 | Rock et al. | 312/140 |
| 4,146,280 | A | * | 3/1979 | Crownhart | 312/305 |
| 4,433,885 | A | * | 2/1984 | Baker | 312/305 |
| 4,440,459 | A | * | 4/1984 | Hallgren | 312/238 |
| 4,995,683 | A | * | 2/1991 | Albiez | 312/348.4 |
| 5,249,856 | A | * | 10/1993 | Dreier | 312/238 |
| 5,662,398 | A | * | 9/1997 | Swallow | 312/238 |
| 5,860,718 | A | | 1/1999 | Brüstle | |
| 6,561,605 | B1 | * | 5/2003 | Akers | 312/348.1 |
| 6,609,774 | B2 | * | 8/2003 | Banicevic et al. | 312/330.1 |
| 6,961,988 | B2 | * | 11/2005 | Koons | 29/525.11 |

FOREIGN PATENT DOCUMENTS

| | | | |
|---|---|---|---|
| AT | 328 651 | | 4/1976 |
| AT | 404664 | | 1/1999 |
| EP | 0263364 | | 4/1988 |
| EP | 451737 | * | 10/1991 |
| GB | 2 169 492 | | 7/1986 |
| JP | 2003070574 | * | 3/2003 |
| NZ | 507687 | * | 9/2001 |

* cited by examiner

*Primary Examiner* — Hanh V Tran
(74) *Attorney, Agent, or Firm* — Wenderoth, Lind & Ponack, L.L.P.

(57) ABSTRACT

A drawer includes comprising two drawer frame members, a rear wall, a drawer bottom and a front facing panel. The front facing panel is angled inwardly and fixed adjustably to the drawer.

7 Claims, 14 Drawing Sheets

DRAWER

BACKGROUND OF THE INVENTION

The invention relates to a drawer comprising two drawer frame members, a rear wall, a drawer bottom and a front facing panel.

It is the usual practice, in relation to kitchen corner cupboards, to provide in the corner an inclined facing panel cover. The object of the invention is to improve a drawer of that kind.

SUMMARY OF THE INVENTION

The object according to the invention is attained in that the front facing panel is angled inwardly and fixed adjustably to the drawer. It is advantageously provided that the front facing panel is formed by at least two separate panels which are connected adjustably to each other. In order to provide for even better use of space in the case of a corner drawer, an embodiment of the invention provides that the rear wall is angled outwardly.

BRIEF DESCRIPTION OF THE DRAWINGS

An embodiment of the invention is described hereinafter by way of example with reference to the Figures of the accompanying drawings, in which.

DETAILED DESCRIPTION OF THE INVENTION

Disposed on both sides of the drawer 1 according to the invention are conventional drawers 40 with facing panels 41 which adjoin the panel portions 7 of the drawer 1.

Figure 1:
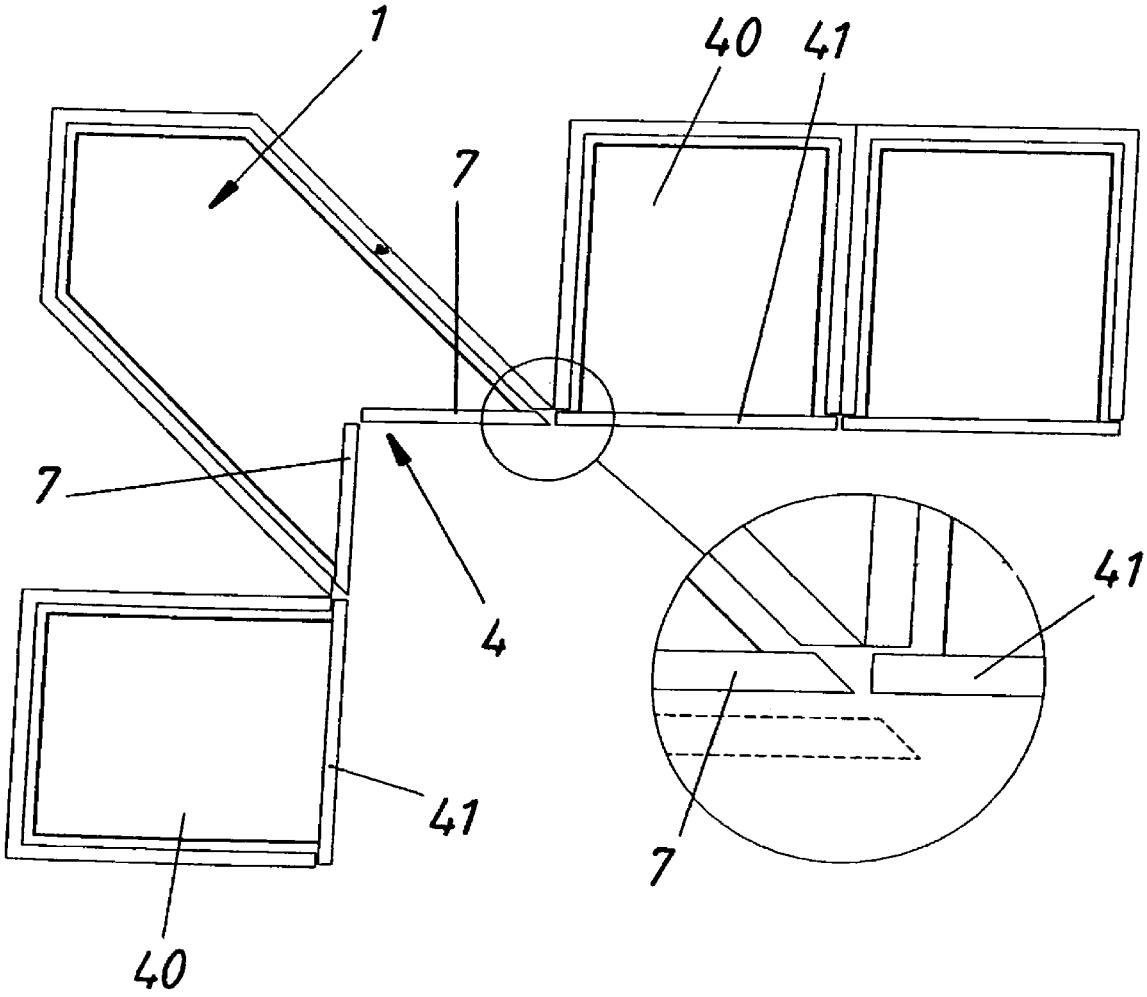
FIG. 1 is a plan view of a kitchen cupboard with drawers according to the invention.
Figure 2:
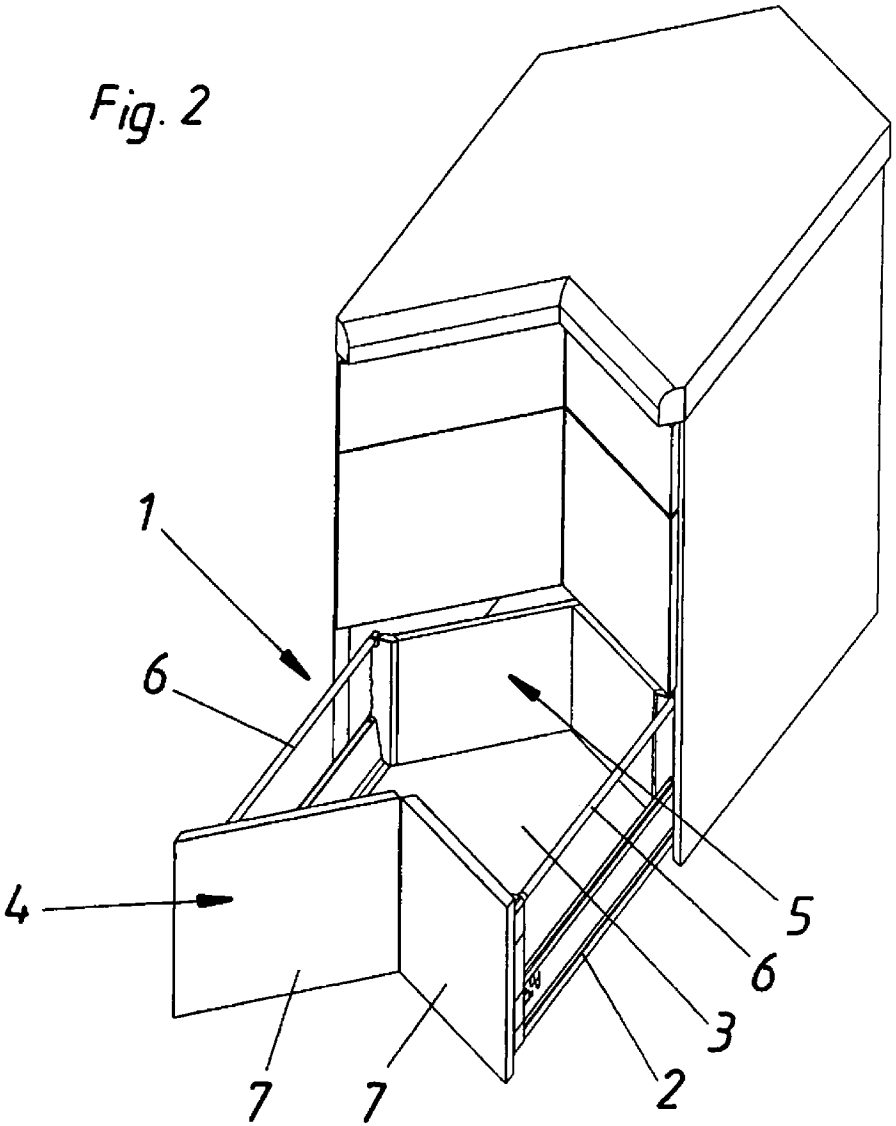
FIG. 2 is a perspective view of a corner cupboard with drawers according to the invention.

FIG. 2 shows a perspective view of a corner cupboard with drawers 1 according to the invention. The drawer 1 according to the invention is provided in a conventional manner with drawer frame members 2 and a drawer bottom 3. The front facing panel 4 of the drawer 1 has an inwardly angled configuration, and the drawer rear wall 5 has an outwardly angled configuration. The front facing panel 4 is thus adapted to the corner in the room and the angled drawer rear wall 5 provides for better use of space.

The front facing panel 4 and the drawer rear wall 5 are connected together at both sides of the drawer 1 by rails 6 which each extend above the respective drawer frame member 2.

The front facing panel 4 is formed by two panel portions 7 which are disposed at a right angle relative to each other, and the drawer rear wall 5 is formed by two panel portions 8 which are also disposed at a right angle to each other. The panel portions 7 of the front facing panel 4 are connected together adjustably by means of a fitment 9 and fixed by holding members 10 to the drawer frame members 2. Anchoring of the holding members 10 to the drawer frame members 2 is described for example in Austrian patent AT 404 664 and in Austrian utility model AT 3 410 U. The fitment 9 is shown in greater detail in FIGS. 9 through 12. It comprises three metal angle portions 11, 12, 13 which are clampingly connected together by means of screws 14 and nuts 15.

The angle portion 11 has at its bottom a flange 16 which projects at a right angle and by way of which the angle portion 11 can be fixed to the drawer bottom 3, for example being screwed thereto. Laterally, the angle portion 11 has inclinedly angled limbs 17 against which the angle portions 12, 13 bear in the assembled condition. The screws 14 extend through vertical slots 18 in the first angle portion 11. The second and third angle portions 12, 13 have a fixing region 19, 20, respectively, which, in the assembled condition, bears against the first angle portion 11 and from which extends a respective holding flap 21 to which a respective panel portion 7 is screwed. The second angle portion 12 is provided in the fixing region 19 with vertical slots 23 and the holding flap 21 has horizontal slots 24. The holding flap 22 of the third angle portion 13 in turn has slots 25 while in the fixing region 20 the third angle portion 13 is provided with round holes 26.

The vertical slots in the first angle portion 11 make it possible for the second and third angle portions 12, 13 and thus the panel portions 7, when the screws 14 are loosened, to be displaced individually or jointly in respect of height. When the panel portions 7 are in the correct position in relation to the height of the article of furniture, the screws 14 are tightened. In that way, the horizontal gaps between the drawers 1 can be exactly adjusted.

The horizontal slots 24, 25 in the angle portions 12, 13 permit horizontal displacement of the panels 7 relative to each other so that exact positioning of the panel portions 7 is also possible in the horizontal direction.

Provided between the holding members 10 and the panel portions 7 are adaptors 27 which in plan view have a triangular configuration. The adaptors 27 are screwed to the panel portions 7 by screws 28. In that case, the screws 28 are accommodated in a slot 29 in a base portion 30 of the adaptor 27. It is also possible to provide a hole with a diameter which is substantially larger than the diameter of the screw 28. In that case, it would also be possible for the adaptor 27 to be adjusted on the respective panel portion 7. That arrangement provides that the panel portions 7 can be adjusted horizontally individually but also jointly.

The holding members 10 are screwed to the adaptors 27 by means of screws 31. The two panel portions 7, the fitment 9, the adaptors 27 and the holding members 10 form a unit. Upon assembly of the front facing panel 4, the holding members 10 are pushed into the drawer frame members 2 and held there by spring-loaded arresting members. Such a front facing panel anchorage arrangement is shown for example in Austrian utility model AT 003 410 U1. Heightwise adjustment of that unit (panels 7, adaptors 27 and holding members 10) is effected in the drawer frame members 2 between the holding members 10 and the arresting members.

The drawer rear wall 5 comprises two panel portions 8 which are disposed at a right angle to each other and which for example are screwed or glued together. There is, however, also the possibility of the panel portions 8 being connected together by a fitment 9 as serves to connect the panel portions 7.

There are provided holding members 32, by means of which the panel portions 8 are fixed to the drawer frame members 2. The holding members 32 also serve for rear anchorage of the rails 6.

At the front, the drawer bottom 3 has a recess and at the rear it has a rearwardly outwardly extending point so that it is matched to the angled shape of the front facing panel 4 and the rear wall 5.

Figure 3:
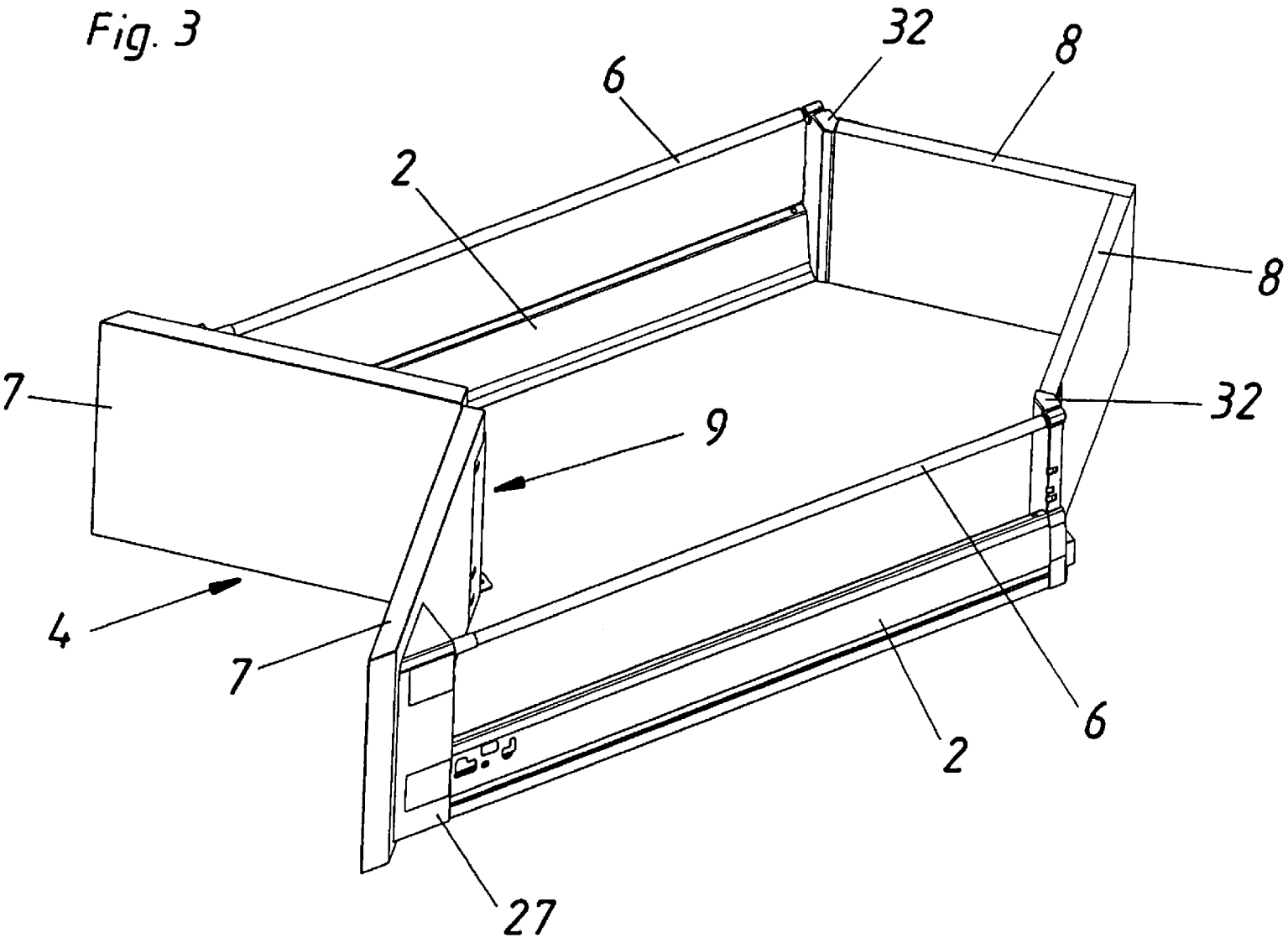
FIG. 3 is a perspective view of a drawer according to the invention.
Figure 4:
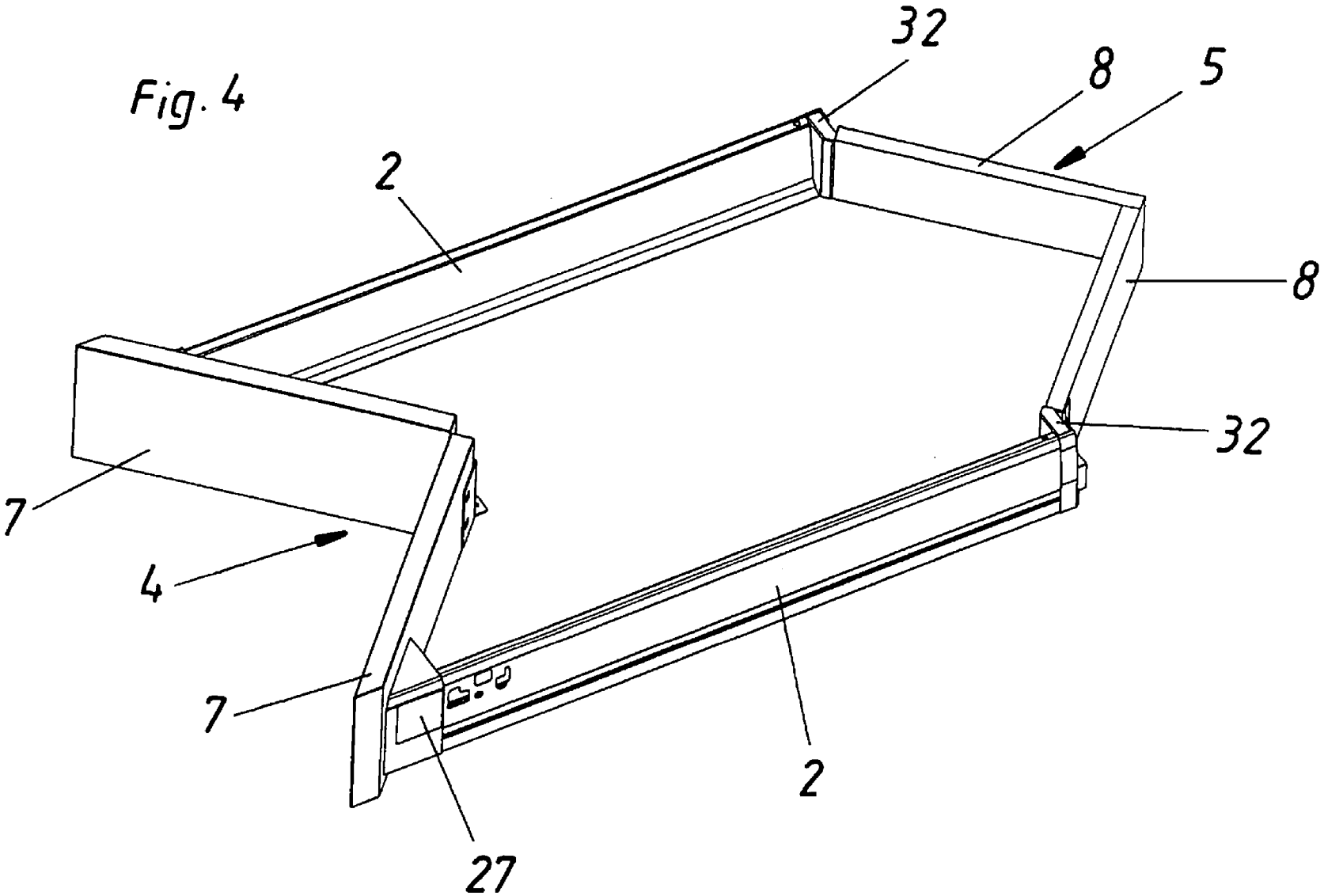
FIG. 4 is a perspective view of a further embodiment of a drawer according to the invention.
Figure 5:
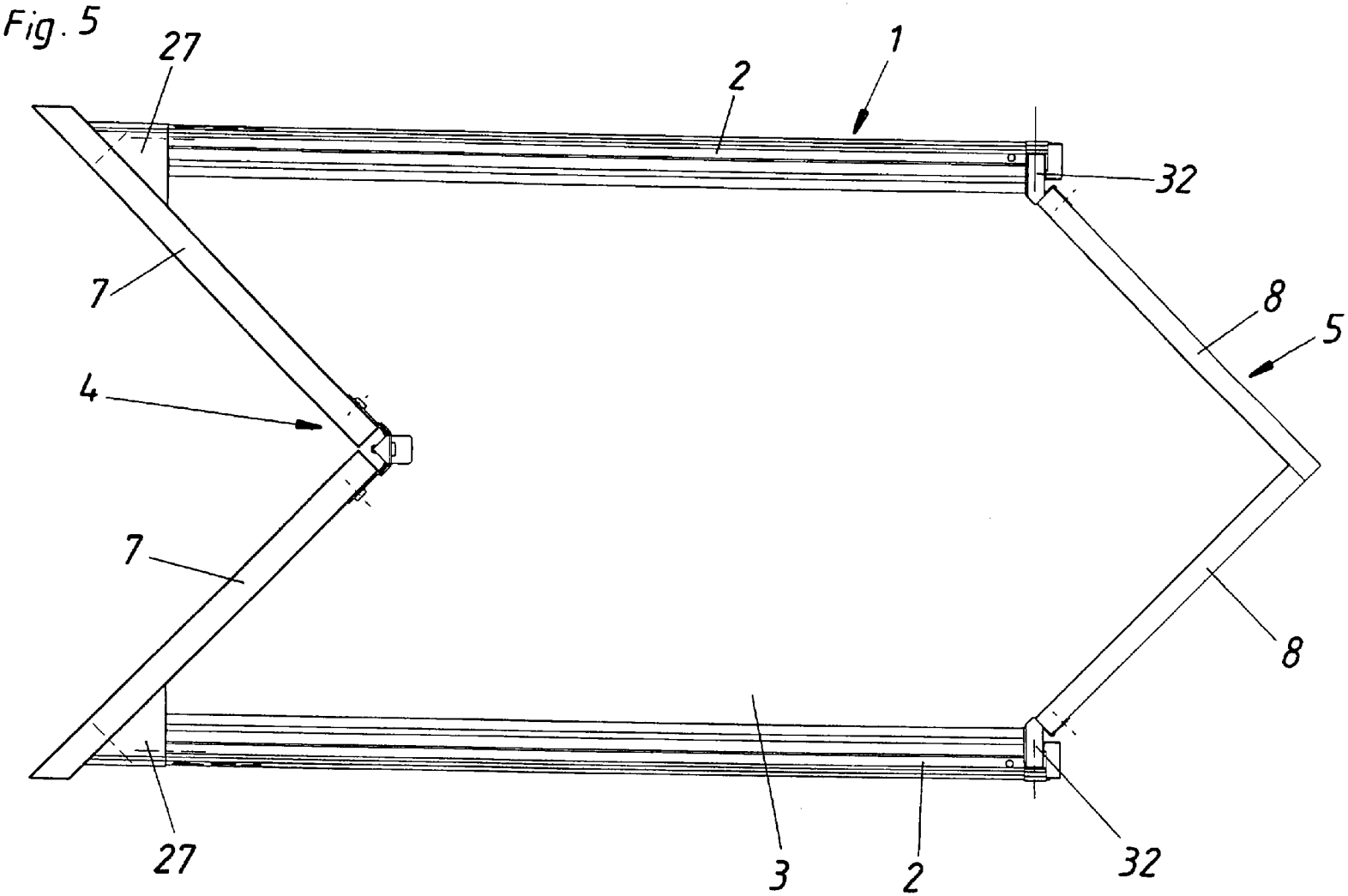
FIG. 5 is a plan view of a drawer according to the invention.
Figure 7:
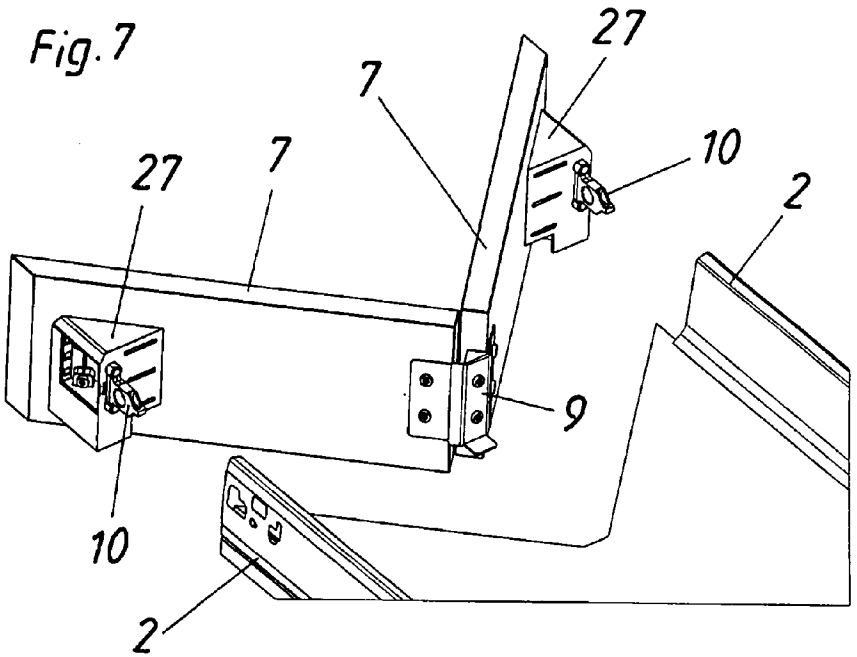
FIG. 7 is a perspective view of the front region of the drawer, showing the front facing panel prior to fitting.
Figure 6:
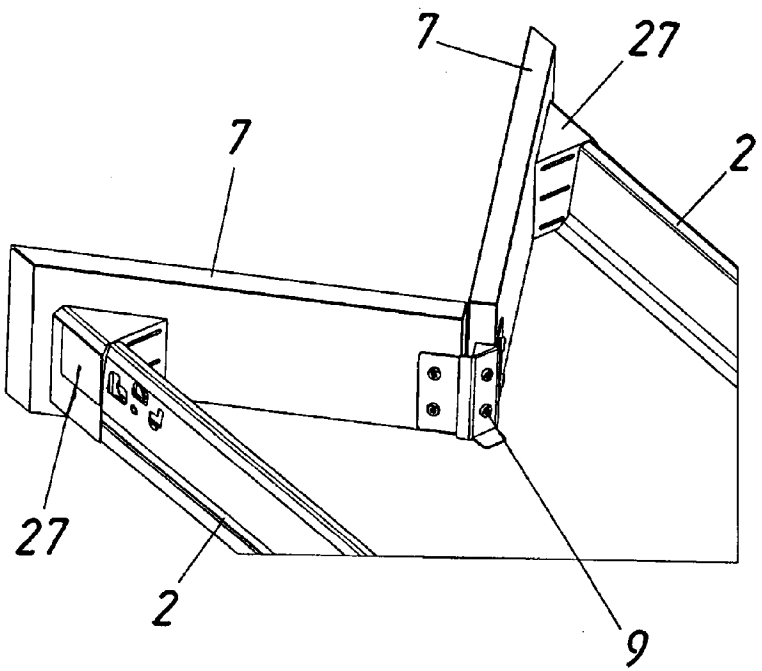
FIG. 6 is a perspective view of the front region of a drawer with the facing panel fixing.
Figure 8:
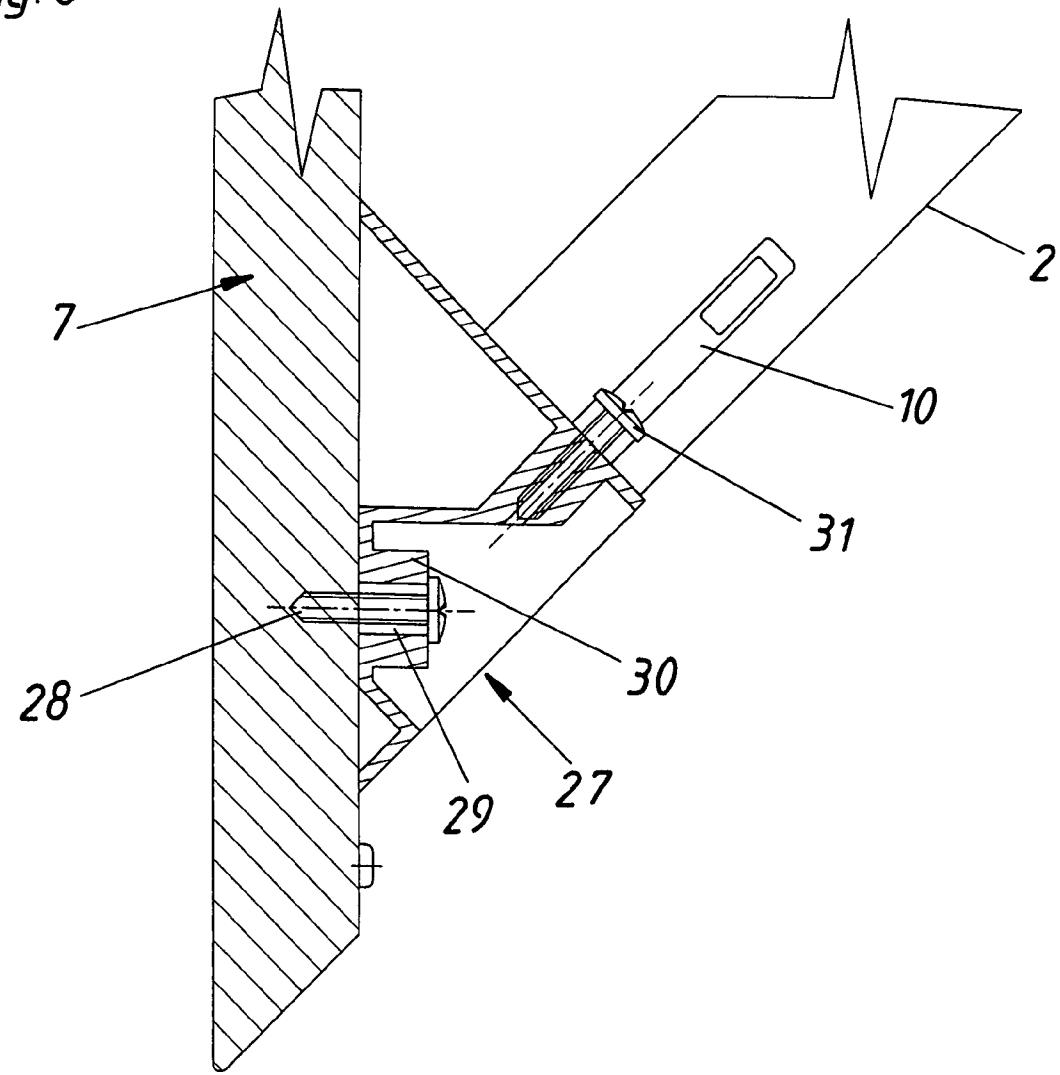
FIG. 8 is a view in section through the front facing panel and an adaptor.
Figure 9:
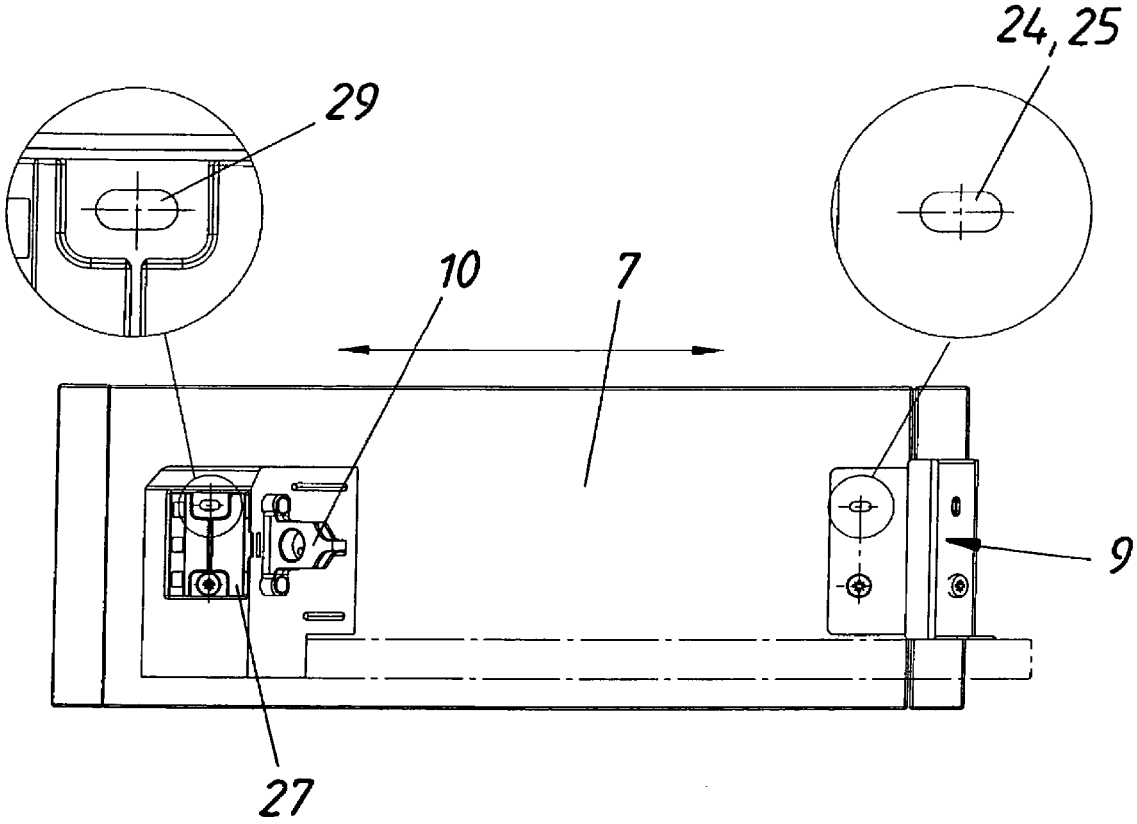
FIG. 9 is a view of the side of a front facing panel, which is towards the drawer.
Figure 10:
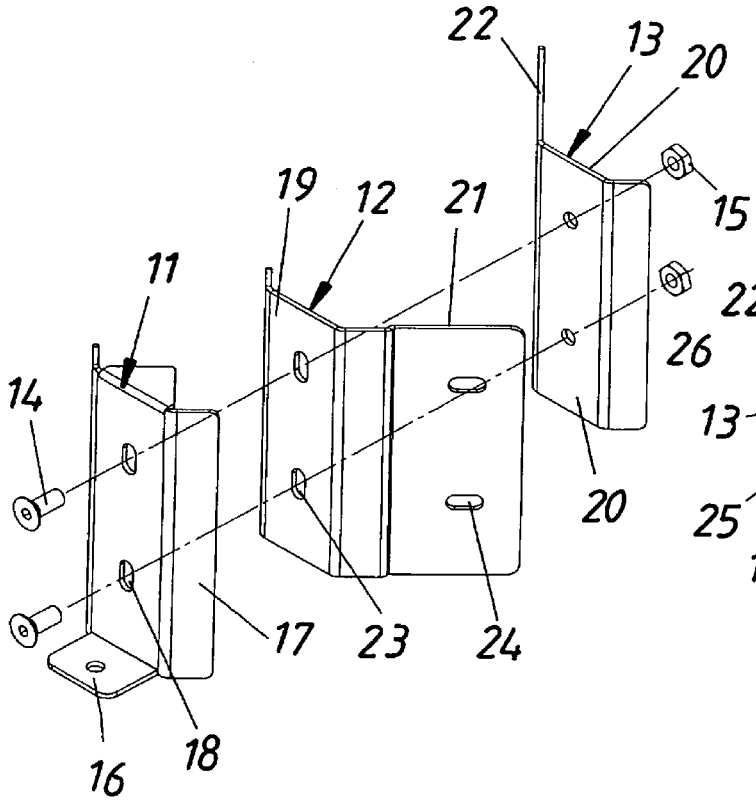
FIG. 10 is an exploded perspective view of a fitment according to the invention.
Figure 11:
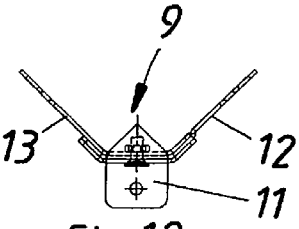
FIG. 11 is a plan view of a fitment according to the invention.
Figure 12:
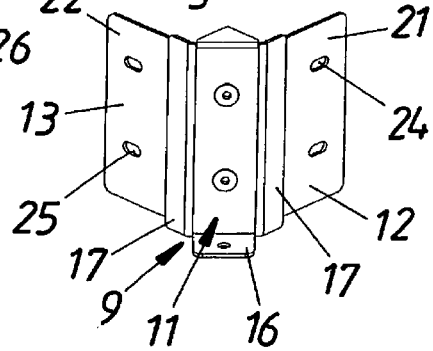
FIG. 12 is a perspective view of a fitment according to the invention.
Figure 13:
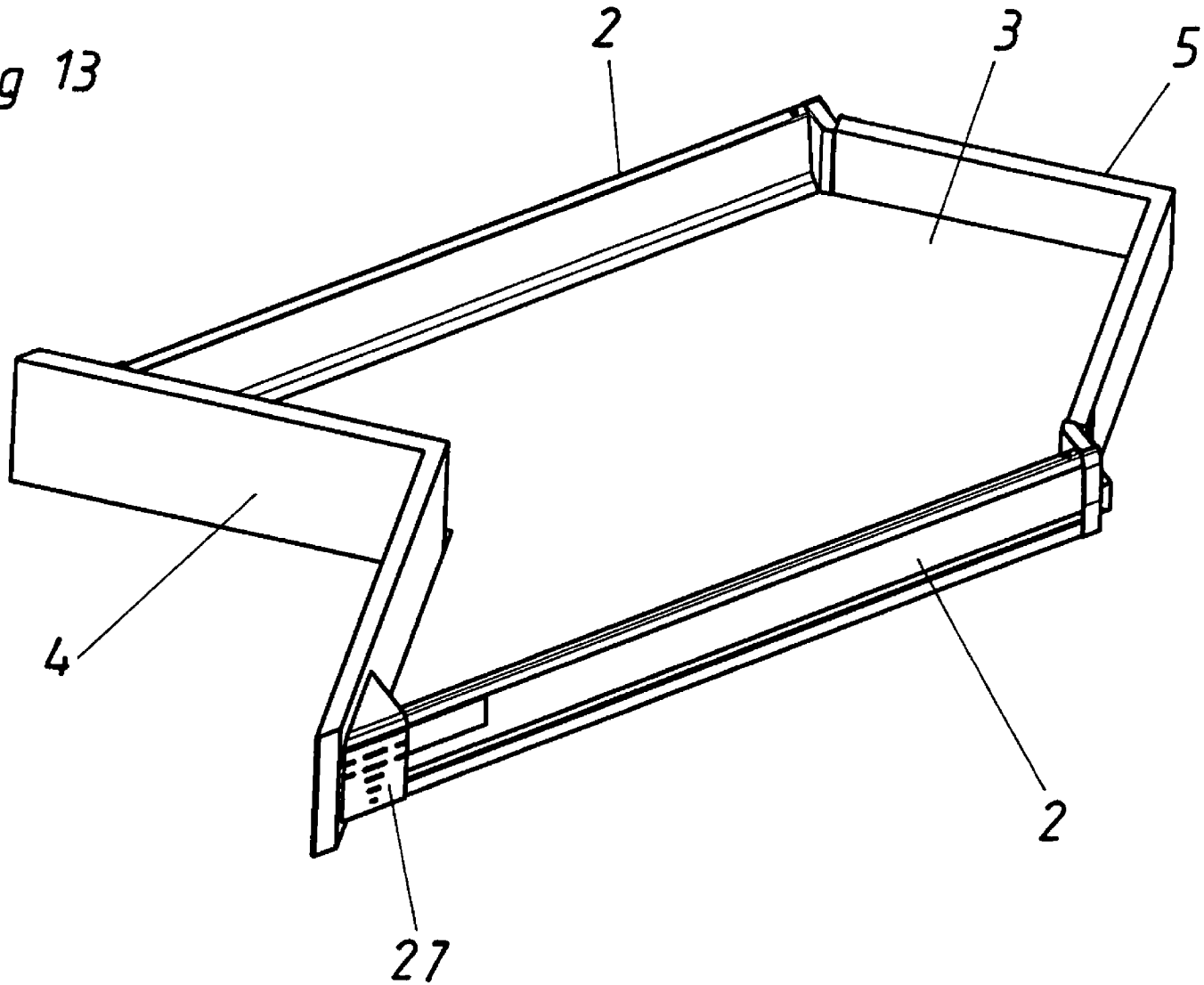
FIG. 13 is a perspective view of a further embodiment of a drawer according to the invention.
Figure 14:
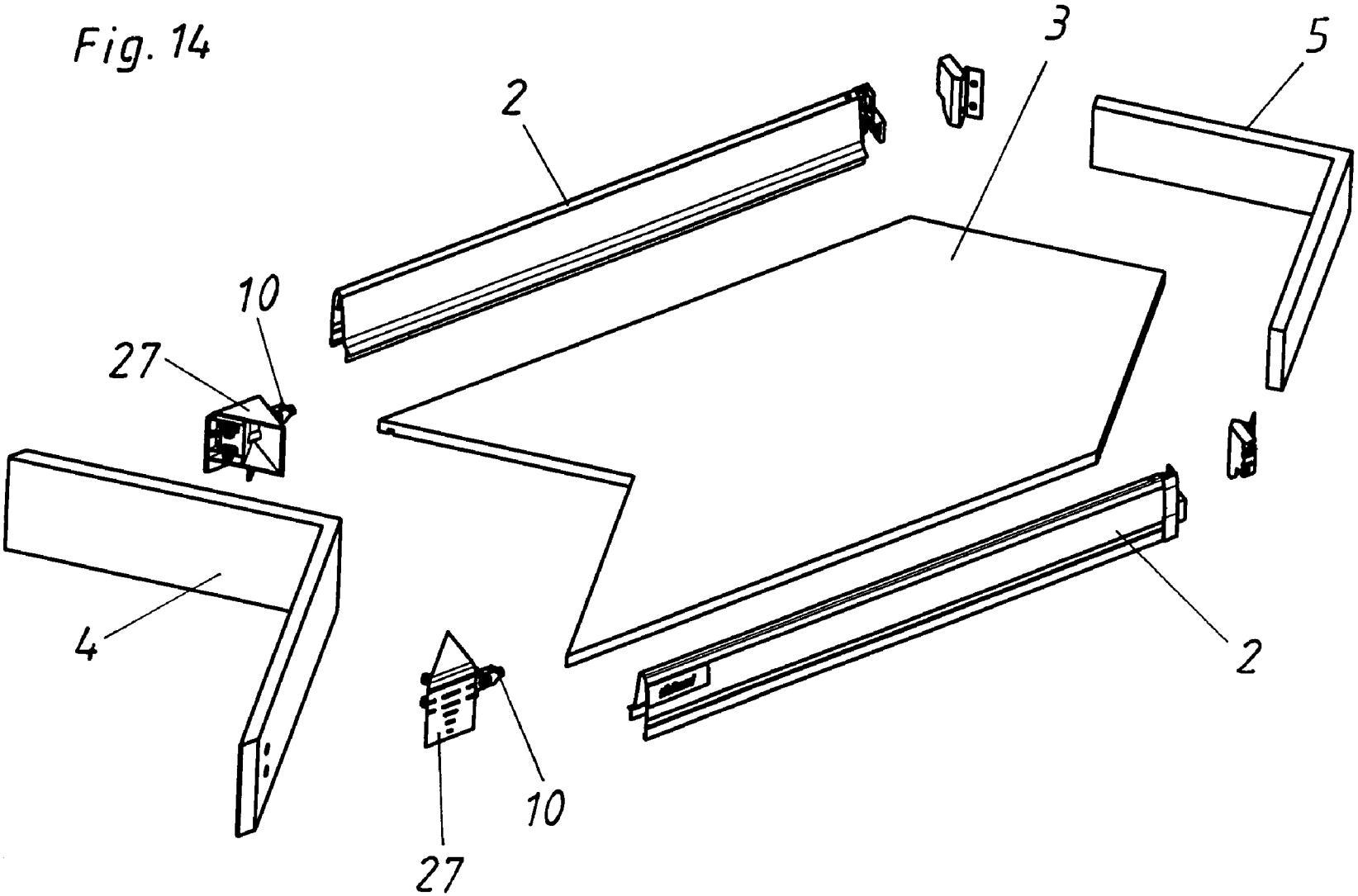
FIG. 14 is an exploded perspective view of that drawer.

The embodiment shown in FIG. 4 differs from the embodiment of FIG. 3 only in that the front facing panel 4 and the rear wall 5 are lower and no rails 6 are provided.

Figure 16:
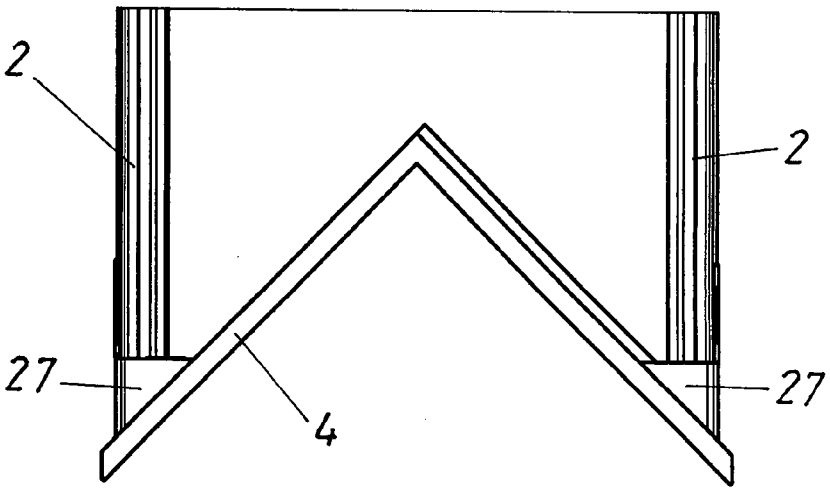
FIGS. 15 and 16 are plan views of the front region of a drawer according to the invention, showing the front facing panel adjustment option.
Figure 15:
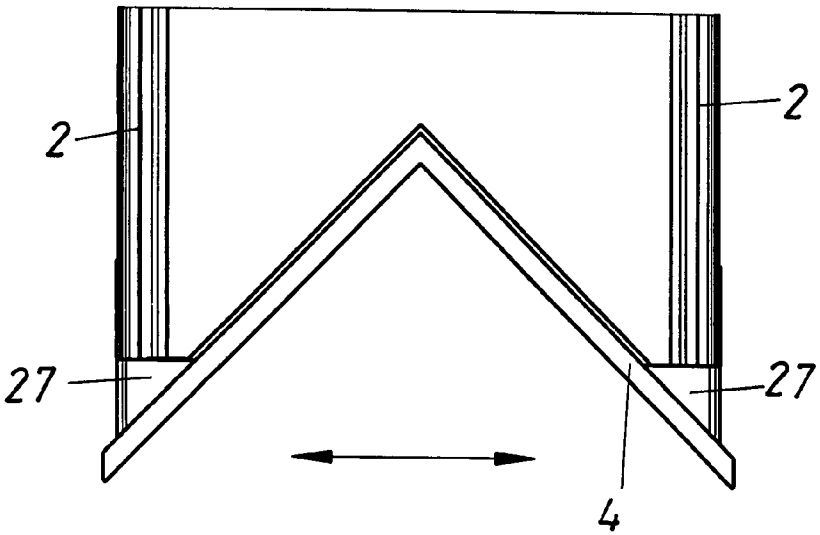

In the embodiment shown in FIGS. 13 through 16, the front facing panel 4 is made in one piece (i.e., has a one-piece construction). The front facing panel 4 is again anchored by means of adaptors 27 and holding members 10 in the drawer frame members 2. As in the embodiment described hereinbefore, adjustment of the front facing panel 4 is possible both in the direction of the height of the drawer 1 and also in the direction of the width of the drawer 1. The adjustability of the front facing panel 4 in the direction of the width of the drawer 1 is shown in FIGS. 15 and 16.

Figure 17:
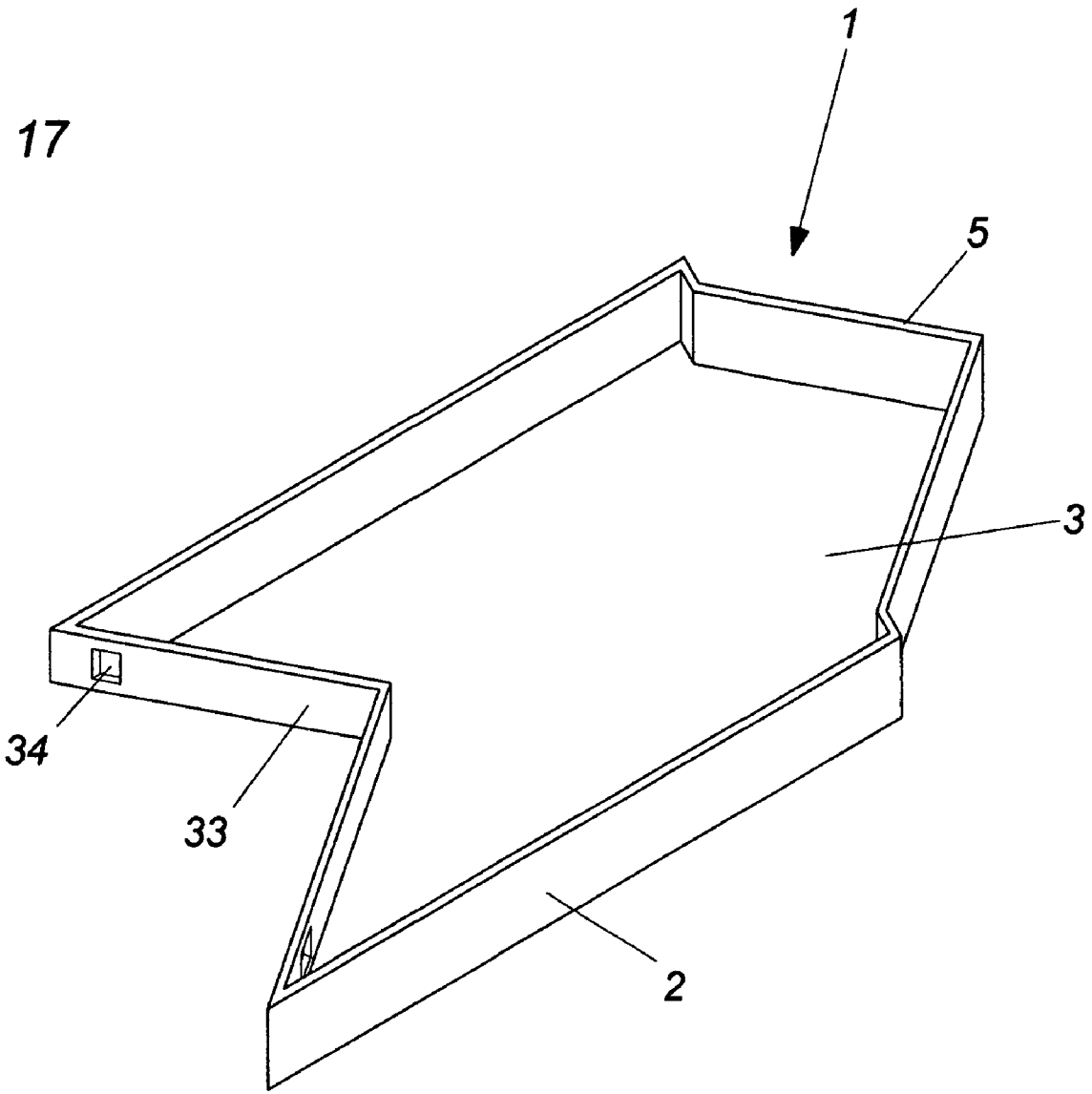
FIG. 17 shows a perspective view of a further embodiment of a drawer according to the invention.
Figure 18:
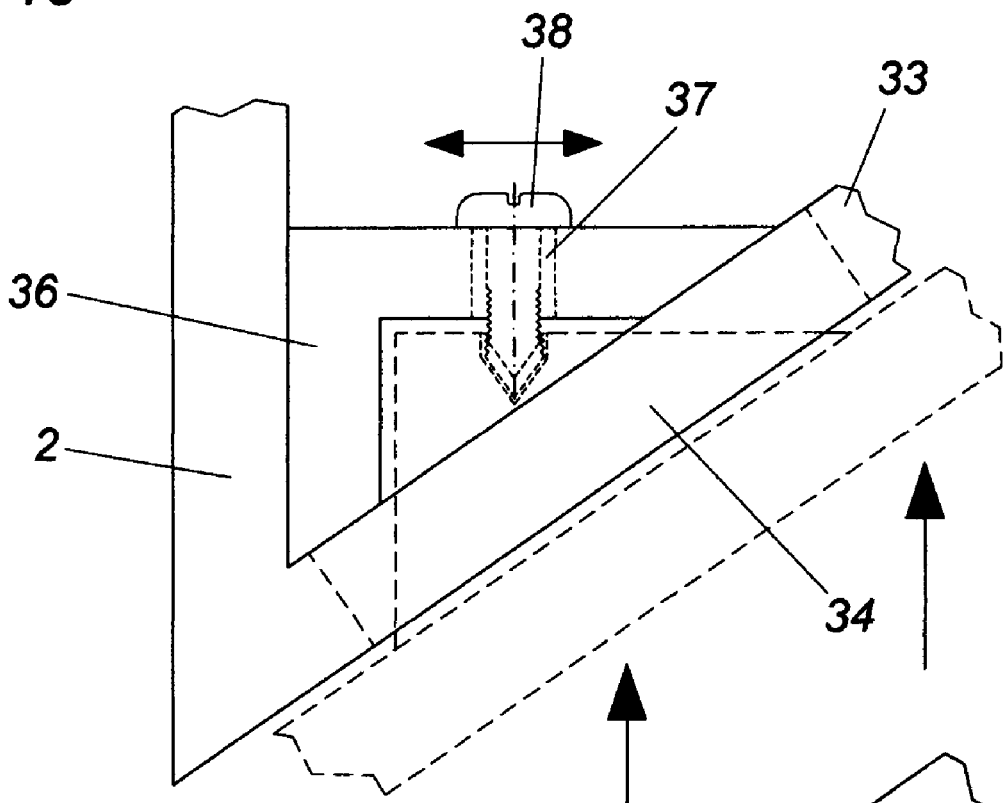
FIG. 18 shows a plan view of a front corner region.
Figure 19:
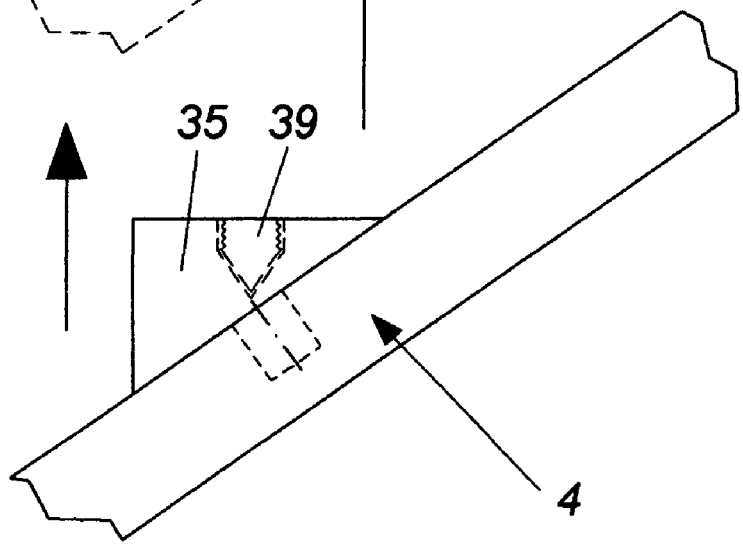
FIG. 19 shows a plan view of a side of a front facing panel.

In the embodiment shown in FIGS. 17 through 19 the drawer 1 is designed with a front base panel 33 which also has an inwardly angled configuration. This embodiment is preferred in particular in relation to drawers which are made entirely from wood.

The front facing panel 4 which is preferably also made from wood is fixed on the front base panel 33.

The front base panel 33 has two openings 34 and angled adaptors 36 are fitted at the inside into the corner regions between the drawer frame members 2 and the front base panel 33. Holding members 35 are fixed to the front facing panel 4, being for example screwed or pegged to the front facing panel 4. The holding members 35 are provided with blind holes 39 with a female screwthread, into each of which is screwed a respective fixing screw 38. The adaptors 36 have holes 37 through which the fixing screws 38 project. In the illustrated embodiment, the diameter of the holes 37 is so much larger than the diameter of the shank of the fixing screw 38 that displacement of the front facing panel 4 is possible both in the direction of the height of the drawer 1 and also in the direction of the width of the drawer 1. The holes 37 could also be in the form of slots. When the front facing panel 4 is in its correct position, the fixing screws 38 are tightened within hole 39 and the front facing panel 4 is clamped to the front base panel 33. The front facing panel 4 and the front base panel 33 are angled inwardly at right angles.

The invention claimed is:

1. A drawer comprising:

two drawer frame members;

a rear wall attached to said drawer frame members;

a drawer bottom between said drawer frame members; and a front facing panel adjustably attached to said drawer frame members, said front facing panel including at least two panel portions connected to each other by a fitment, said fitment including a first angle portion connected to a first one of said panel portions, a second angle portion connected to a second one of said panel portions, and a third angle portion connected to said drawer bottom.

2. The drawer of claim 1, wherein said third angle portion has two lateral angled limbs against which said first angle portion and said second angle portion bear.

3. A drawer comprising:

two drawer frame members;

a rear wall attached to said drawer frame members;

a drawer bottom between said drawer frame members; and a front facing panel adjustably attached to said drawer frame members, said front facing panel including at least two panel portions adjustable relative to one another and arranged so that said front facing panel is angled inwardly;

wherein said panel portions are connected together by a fitment;

wherein said fitment includes at least two angle portions screwed to each other; and wherein a first one of said angle portions has vertical slots, a second one of said angle portions has horizontal and vertical slots, and a third one of said angle portions has horizontal slots and round holes.

4. A drawer comprising:

two drawer frame members;

a rear wall attached to said drawer frame members;

a drawer bottom between said drawer frame members; and a front facing panel adjustably attached to said drawer frame members, said front facing panel including at least two panel portions adjustable relative to one another and arranged so that said front facing panel is angled inwardly;

wherein said panel portions are connected together by a fitment; and wherein said fitment includes three angle portions, two of said three angle portions each being connected to a respective one of said panel portions, and a third angle portion being connected to said drawer bottom.

5. The drawer of claim 4, wherein said angle portions are connected by a screw.

6. The drawer of claim 4, wherein said third angle portion has two lateral angled limbs against which said two of said three angle portions bear.

7. The drawer of claim 4, wherein a first one of said angle portions has vertical slots, a second one of said angle portions has horizontal and vertical slots, and a third one of said angle portions has horizontal slots and round holes.

* * * * *